United States Patent [19]

Mobley et al.

[11] Patent Number: 4,713,026

[45] Date of Patent: Dec. 15, 1987

[54] TAB RECEPTACLE TERMINAL HAVING IMPROVED ELECTRICAL AND MECHANICAL FEATURES

[75] Inventors: Dewey F. Mobley, Lake Orion; Janice M. Warren, New Hudson; August Barbrick, Plymouth, all of Mich.; Gregg A. Eisenmann, Parma, Ohio

[73] Assignee: Interlock Corporation, Westland, Mich.

[21] Appl. No.: 916,950

[22] Filed: Oct. 8, 1986

[51] Int. Cl.[4] ..... H01R 13/11

[52] U.S. Cl. ..... 439/845

[58] Field of Search ..... 339/256 SP, 258 RR, 339/258 S

[56] References Cited

U.S. PATENT DOCUMENTS 2,794,963 6/1957 Hess et al. ..... 339/256 SP
3,550,067 12/1970 Hansen ..... 339/256 SP
3,550,069 12/1970 Teagno ..... 339/256 SP
3,729,701 4/1973 Smith ..... 339/258 S

*Primary Examiner*—Joseph H. McGlynn
*Attorney, Agent, or Firm*—Harness, Dickey & Pierce

[57] ABSTRACT

A tab receptacle terminal fabricated by bending a single sheet of electrically conductive material comprising a receptacle box having an end opening through which a male terminal is inserted so as to make contact with the receptacle box. The receptacle box includes a bottom, top, and sides, the top including a leaf spring which extends toward the bottom and may be formed with a terminal projection extending toward the bottom for engagement with a male terminal inserted into the receptacle box. Fixed beams formed on the bottom and extending toward the leaf spring for engagement with a male terminal with normal force applied by the leaf spring toward the bottom to complete the electrical connection.

9 Claims, 11 Drawing Figures

TAB RECEPTACLE TERMINAL HAVING IMPROVED ELECTRICAL AND MECHANICAL FEATURES

BACKGROUND OF THE INVENTION

This invention relates generally to electrical terminals and more particularly to a fabricated tab receptacle terminal which is capable of establishing improved electrical contact with a male terminal and having more desirable insertion and removal forces.

Electrical terminals of the tab receptacle type are in common use in appliances, automobiles, etc. and are an essential component in many products. The object of this invention is to provide an improved tab receptacle terminal that is reliable in repeatedly establishing good contact and has the capability for carrying high electrical currents for the size of the terminal.

SUMMARY OF THE INVENTION

The tab receptacle terminal of this invention includes an end opening through which a male terminal is inserted so as to make improved contact with the tab receptacle. The tab receptacle may be used in a discreet application, or in multiple connectors, or any other fabricated array that might be designed e.g. a buss bar or lead frame.

The tab receptacle is a formed rectangular box, the top is configured so as to form a leaf spring therein which extends toward the bottom but is resiliently movable away from the bottom so as to provide firm electrical contact of the leaf spring with a male terminal inserted into the tab receptacle terminal through the open end. Improved retention between the leaf spring and the male terminal can be provided by forming a terminal projection on the leaf spring extending toward the bottom of the terminal which drops into a detent or hole in the male blade.

A pair of fixed beams are formed out of the bottom so that they extend toward the leaf spring. This enables the male terminal to be engaged between the leaf spring on one side and the fixed beams on the other side to allow for firm electrical contact. The result is an assembly in which the normal force is applied to a male terminal by the leaf spring on one side against fixed beams on the other side.

The beams are formed with inclined ramps toward the end opening of the terminal to facilitate the insertion of a male terminal into the tab receptacle and the leaf spring is partially separated from the top at its sides to implement yielding movement of the leaf spring.

Interlocking tabs are formed on the ends of the single sheet of material from which the tab receptacle is formed to maintain the box in its desired rectangular form in which the leaf spring extends toward the fixed beams. Stabilizing nibs are formed on the bottom wall diagonally opposite to the interlocking tabs in order to maintain the tab receptacle terminal in a fixed position in the cavity of a connector.

The result is a female terminal of the tab receptacle type which provides for improved electrical contact and improved current carrying capabilities.

Further objects, features and advantages of the invention will become apparent from a consideration of the following description and the appended claims when taken in connection with the accompanying drawing in which:

Figure 1:
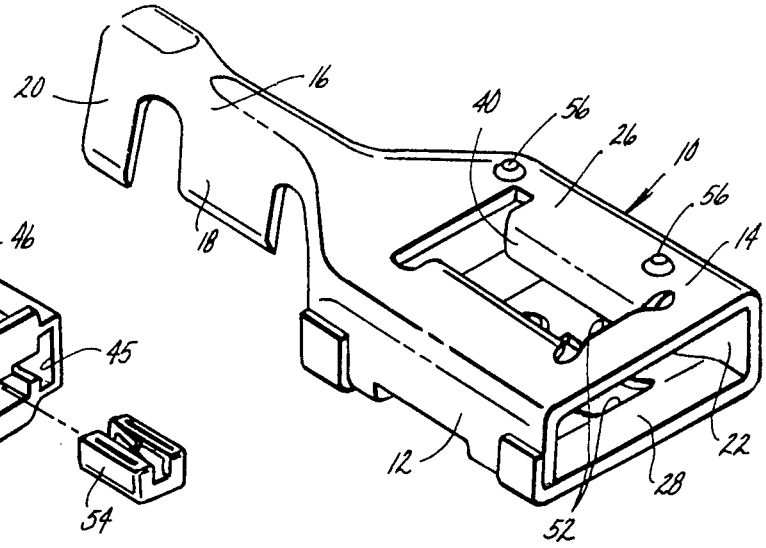
FIG. 1 is a perspective view of the improved tab receptacle terminal of this invention, showing particularly the bottom side of the terminal.
Figure 2:
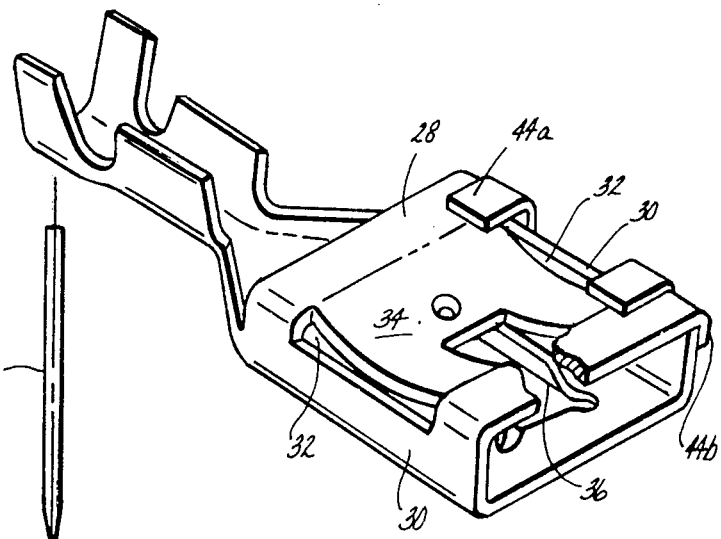
FIG. 2 is a perspective view of the female terminal of this invention, like FIG. 1 but showing particularly the top of the terminal, with some parts broken away and other parts shown in section for the purpose of clarity.

With reference to the drawing, the improved tab receptacle terminal of this invention, indicated generally at 10, is illustrated in FIGS. 1 and 2 as being formed from a single sheet 12 of electrically conductive metal which is bent to form the terminal 10 with a receptacle box 14 and a conductor gripping section 16. The section 16 is formed with conventional conductor wings 18 and insulator wings 20 which are formed in pairs and are crimped into engagement with the conductor and the insulation surrounding the conductor, respectively, that is assembled with the terminal 10. The conductor is stripped of insulation at one end and positioned between the grips 18 which are crimped onto the conductor to insure a firm electrical connection between the conductor and the terminal 10. The grips 20 are crimped onto the insulation as a strain relief for the conductor grip.

Figure 4:
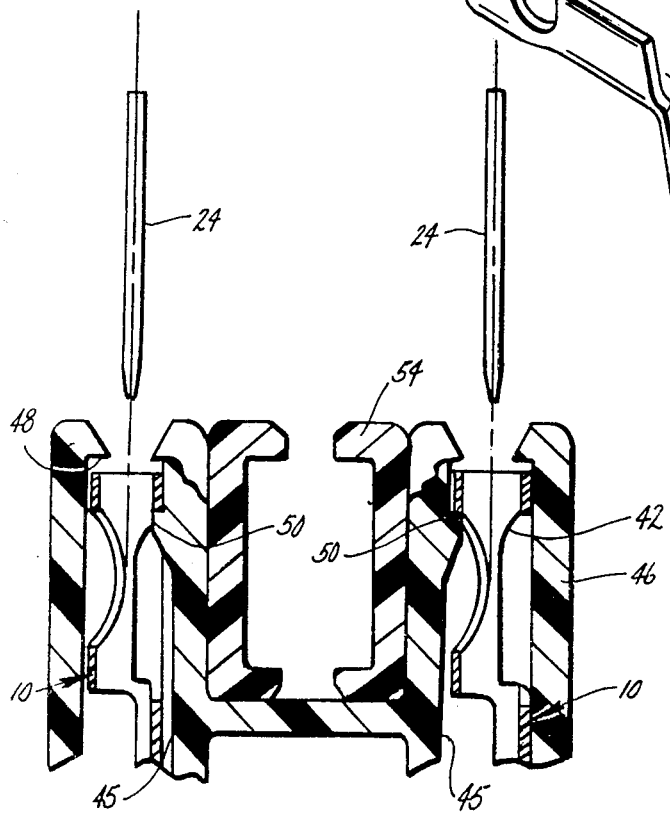
FIG. 4 is a fragmentary enlarged sectional view through a portion of the two way connector showing a pair of male terminals in position to be inserted into the two way connector.
Figure 5:
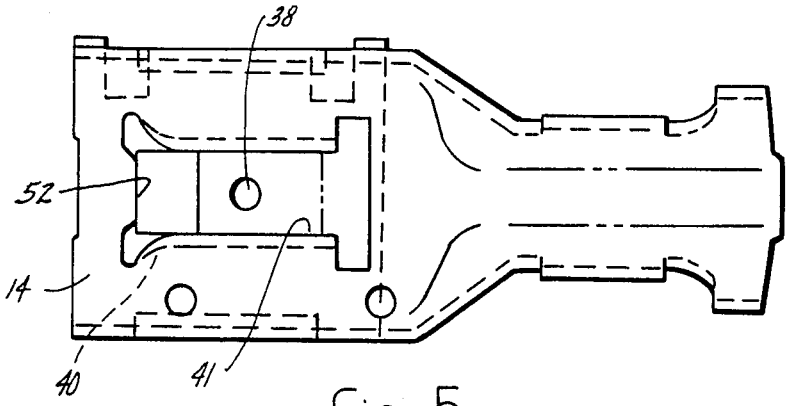
FIG. 5 is a bottom view of the electrical terminal of this invention.

The receptacle box 14 is generally rectangular in shape having an end opening 22 through which a male terminal, indicated at 24 in FIG. 4, is inserted so as to make contact with the receptacle box 14.

The receptacle box 14 also includes a bottom 26, a top 28, and sides 30. Metal is isolated by slots 32 extending lengthwise of the receptacle box 14 and formed at the junctures of the top 28 with the sides 30 to enable the portion of the top 28 between the slots 32 to be formed toward the bottom 26 so as to provide a leaf spring section 34. The leaf spring section 34 will deflect in limited amounts in directions toward and away from the bottom 26.

Figure 6:
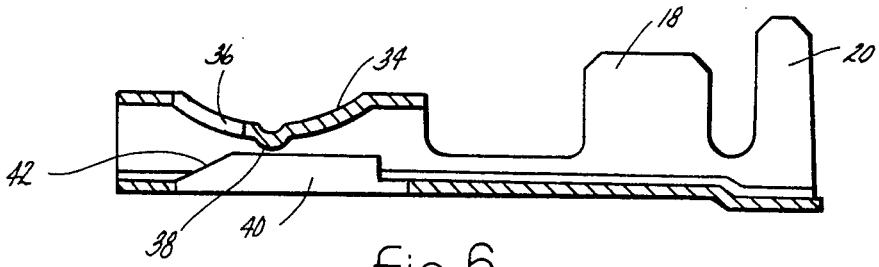
FIG. 6 is a longitudinal sectional view of the electrical terminal of this invention.
Figure 7:
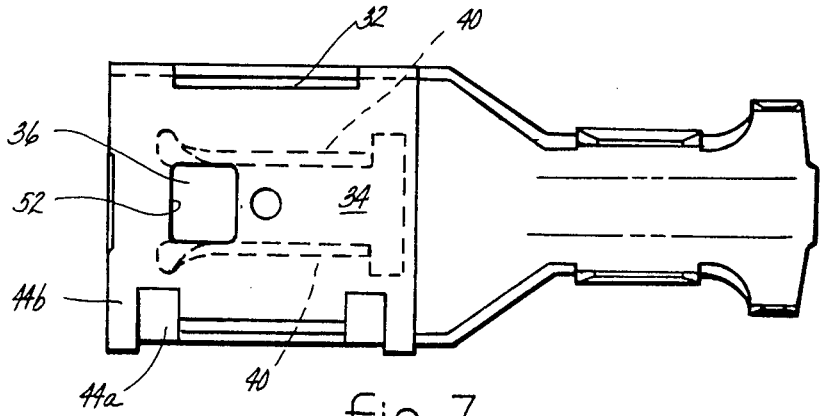
FIG. 7 is a top view of the electrical terminal.
Figure 8:
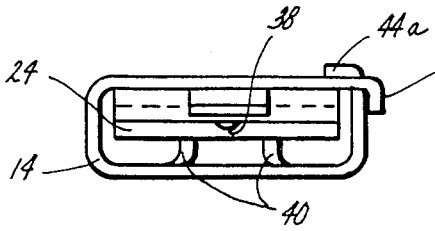
FIG. 8 is an end view of the electrical terminal of this invention as viewed from the open end of the tab receptacle.

A terminal projection 38 may be formed on the leaf spring 34 at a point on the leaf spring 34 closest to the bottom 26, as shown in FIG. 6 to attain retention in discreet applications. An opening 36 in the top 28 forms an edge locking surface that can be used for terminal retention in a connector as shown at 50 in FIG. 4.

As best appears in FIG. 1, a pair of generally rectangular beams 40 are formed out of the bottom wall 26 so as to form an opening 41 of irregular shape in the bottom plate 26. The beams 40 extend upwardly toward the top plate 28 on opposite sides of the leaf spring 34. These beams cause an intimate contact with a mated male terminal by the normal force supplied by the leaf spring 34.

Each of the beams 40 is formed at its end adjacent the opening 22 with an inclined ramp surface 42 to facilitate insertion of a male terminal into the tab receptacle 14. As a result, when a male terminal 24 is inserted into the block 14 through the opening 22, the male terminal 24 is engaged on one side by the leaf spring 34 and on the opposite side by the beams 40. This provides a resilient engagement of the terminal 34 and the beams 40 with the male terminal 24. This resilient engagement enhances the firmness of the electrical connection thereby improving the electrical characteristics of the terminal and the current carrying capabilities of the terminal.

The receptacle box 14 is retained in its rectangular configuration by interlocking tabs **44*a* and 44*b*. As shown in FIG. 2, the tabs 44*a* extend from the side 30 and are formed at 90° over the top 28 to maintain the receptacle box 14 in its rectangular configuration. Similarly tabs 44*b* extend from the top 28 and are formed 90° over the side 30** to lock the box.

Figure 3:
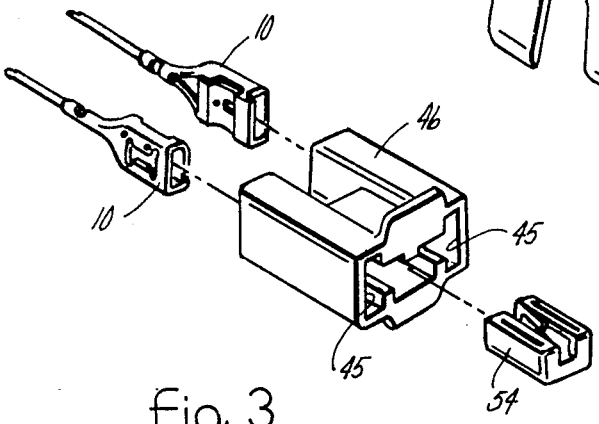
FIG. 3 is an exploded perspective view of a two way connector utilizing a pair of the tab receptacle terminals of this invention.

One of the uses of the terminal 10 is illustrated in FIGS. 3 and 4 in which two of the terminals 10 are inserted into a plastic connector body 46 having two cavities 45.

The terminals 10 are inserted into the cavities 45 in connector body 46 to stop positions in which the open ends of the receptacle boxes 14 engage stop projections 48 in the body 46. Wedge shape stops 50 deflect to one side during insertion of the terminals 10 into the cavities 45 and engage the edge surfaces 52 on the bottom or top 26 to prevent withdrawal of the terminals 10 from the plastic body 46 and maintain the assembly of the terminals 10 with the connector block 46. A locking wedge 54 is inserted in the connector body 46 between the openings 45 to maintain the stops 50 in positions in which they positively prevent withdrawal of the terminals 10 and maintain the connector assembly. Nibs 56 formed on the bottom 26 engage the plastic body 46 to stabilize the position of the terminals 10 within the body 46.

In these positions of the terminals 10, the male terminals can be inserted, as shown in FIG. 4 and as hereinafter described, to provide the desired electrical connection of male terminals 24 and tab receptacle terminals 10 within the connector block 46.

Figure 9:
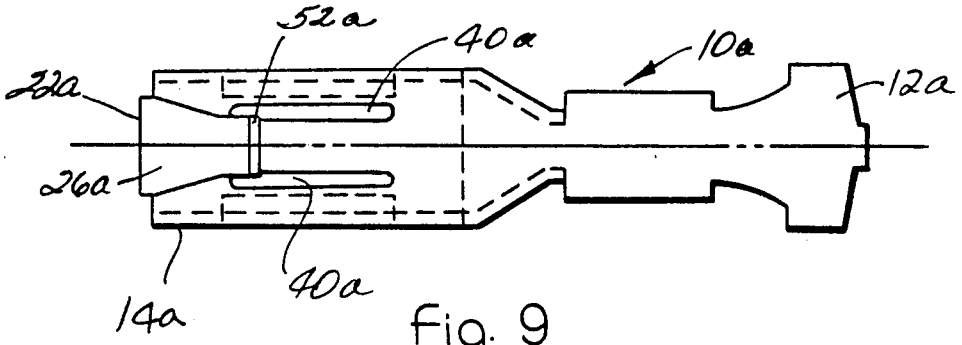
FIG. 9 is a bottom view of a modified form of the tab receptacle terminal of this invention.
Figure 10:
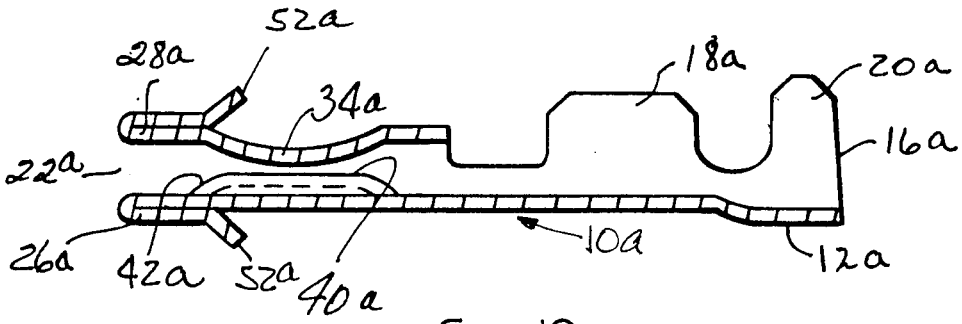
FIG. 10 is a longitudinal sectional view of the terminal showed in FIG. 9.
Figure 11:
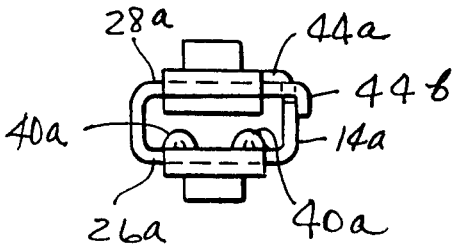
FIG. 11 is an end view of the tab receptacle terminal shown in FIGS. 9 and 10 as viewed from the open end of the receptacle.

A modified form of the tab receptacle terminal of this invention, indicated generally at **10*a*, is illustrated in FIGS. 9, 10 and 11. Numerals with the letter suffix "a" are used in FIGS. 9–11 to indicate parts like the correspondingly numbered parts in the terminal shown in FIGS. 1–8. The terminal 10*a* is formed from a single sheet 12*a* of electrically conductive metal which is bent to form a receptacle box 14*a* and a conductor gripping section 16*a*. The section 16*a* is formed with conventional conductor wings 18*a* and insulator wings 20*a* which are formed in pairs and are crimped into engagement with the conductor and the insulation surrounding the conductor, respectively, that is assembled with the terminal 10*a*. The conductor is stripped of insulation at one end and positioned between the grips 18*a* which are crimped onto the conductor to insure a firm electrical connection between the conductor and the terminal 10*a*. The grips 20*a*** are crimped onto the insulation as a strain relief for the conductor grip.

The receptacle box **14*a* is generally rectangular in shape having an end opening 22*a* through which a male terminal, like the terminal indicated at 24 in FIG. 4, is inserted so as to make contact with the receptacle box 14*a***.

The receptacle box 14 also includes a leaf spring section **34*a* which will deflect in limited amounts in directions toward and away from the bottom 26*a***.

A terminal projection (not shown) like the projections 38 may also be formed on the leaf spring **34*a* at a point on the leaf spring 34*a* closest to the bottom 26*a***, to attain retention in discreet applications.

A pair of generally rectangular beams **40*a* are formed out of the bottom wall 26*a*. The beams 40*a* extend upwardly toward the top plate 28*a* on opposite sides of the leaf spring 34*a*. These beams cause an intimate contact with a mated male terminal by the normal force supplied by the leaf spring 34*a***.

Each of the beams **40*a* is formed at its end adjacent the opening 22*a* with an inclined ramp surface 42*a* to facilitate insertion of a male terminal into the tab receptacle 14*a*. As a result, when a male terminal is inserted into the block 14*a* through the opening 22*a*, the male terminal is engaged on one side by the leaf spring 34*a* and on the opposite side by the beams 40*a* . This provides a resilient engagement of the terminal 34 and the beams 40*a*** with the male terminal. This resilient engagement enhances the firmness of the electrical connection thereby improving the electrical characteristics of the terminal and the current carrying capabilities of the terminal.

The receptacle box 14 is retained in its rectangular configuration by interlocking tabs **44*a* and 44*b*. The bottom and top walls 26*a* and 28*a* are return bent upon themselves, as shown in FIG. 10, to further facilitate male terminal insertion into the box 14*a*, and terminate in edges 52*a* which function as abutments or stops when the terminals are assembled in a connector block such as the block 46 shown in FIGS. 3 and 4, like the edges 52 in the terminal 10** function as abutments.

From the above description, it is deen that this invention provides an improved tab receptacle terminals 10 and **10*a*** with improved electrical connections and improved current carrying capabilities.

What is clalmed is:

1. A tab receptacle terminal fabricated by bending a single sheet of material comprising:

a rectangular receptacle box having a closed continuous wall forming an end opening through which a male terminal is inserted so as to make contact with said receptacle box, said receptacle box including a bottom, a top, and sides, single leaf spring means formed in said top so as to extend across substantially the entire width of said top between said sides, and extending toward said bottom for engagement with a male terminal inserted therebetween to achieve high retention forces, closed slots extending lengthwise along the juncture of said top with said sides to enable deflection of said leaf spring means, and fixed beams formed on said bottom and extending toward said leaf spring means for engagement with a male terminal with normal force applied by said leaf spring means toward said fixed beams.

2. A tab receptacle terminal according to claim 1 wherein said beams are formed from portions of said bottom turned toward said single leaf spring.

3. A tab receptacle terminal according to claim 2 wherein said beams are formed with inclined end ramps adjacent the end opening of said receptacle box to facilitate the insertion of a male terminal into said receptacle box.

4. A tab receptacle terminal according to claim 1 wherein said leaf spring means comprises a portion of said top bowed forwardly and downwardly toward said bottom thence upwardly and terminating abruptly in an edge, a terminal projection on said leaf spring means extending toward said bottom, said terminal projection being located at the inner side of said leaf spring portion where said downward bowing terminates and said upward bowing commences, said edge being spaced from said end opening of said receptacle box and means on opposite sides of said edge spaced from said sides and formed integral with said top at said open end of said receptacle box.

5. A tab receptacle terminal according to claim 4 wherein said receptacle box includes slots located between said top and sides and on opposite sides of said leaf spring facilitating springing movement of said leaf spring in a direction toward and away from said bottom.

6. A tab receptacle terminal according to claim 1 further including interlocking tabs formed at opposite ends of the single sheet of material forming said receptacle box, said interlocking tabs being located at the juncture of top wall and a side wall and at opposite ends of said leaf spring means.

7. A tab receptacle terminal according to claim 6 further including stabilizing nibs on said bottom to one side of said fixed beams and opposite said interlocking tabs.

8. A tab receptacle terminal fabricated by bending a single sheet of material comprising:

a rectangular receptacle box having a closed continuous wall forming an opening through which a male terminal is inserted so as to make contact with said receptacle box, a portion of said box being shaped to form a single flexible leaf spring means for engagement with a male terminal inserted into said box through said end opening and contact means on said box extending toward said leaf spring means for engagement with a male terminal engaged with normal force applied by said leaf spring means toward said contact means.

9. A tab receptacle terminal fabricated by bending a single sheet of material comprising:

a rectangular receptacle box having a closed continuous wall forming an end opening through which a male terminal is inserted so as to make contact with said receptacle box, said receptacle box including a bottom, a top, and sides, said bottom and top being return bent upn themselves at said opening and terminating in edge abutments located above and below said top and bottom, respectively, single leaf spring means formed in said top and extending toward said bottom for engagement with a male terminal inserted therebetween to achieve high retention forces and fixed beams formed on said bottom and extending toward said leaf spring means for engagement with a male terminal with normal force applied by said leaf spring means toward said fixed beams.

* * * * *